US008373516B2

(12) United States Patent
Hernandez

(10) Patent No.: US 8,373,516 B2
(45) Date of Patent: Feb. 12, 2013

(54) WAVEGUIDE MATCHING UNIT HAVING GYRATOR

(75) Inventor: Victor Hernandez, Merritt Island, FL (US)

(73) Assignee: Harris Corporation, Melbourne, FL (US)

( * ) Notice: Subject to any disclaimer, the term of this patent is extended or adjusted under 35 U.S.C. 154(b) by 365 days.

(21) Appl. No.: 12/903,684

(22) Filed: Oct. 13, 2010

(65) Prior Publication Data

US 2012/0092086 A1 Apr. 19, 2012

(51) Int. Cl.
*H01P 1/38* (2006.01)

(52) U.S. Cl. ..... 333/1.1

(58) Field of Classification Search ..... 333/1.1, 333/24.2

See application file for complete search history.

(56) References Cited

U.S. PATENT DOCUMENTS

| | | | |
|---|---|---|---|
| 2,371,459 | A | 3/1945 | Mittelmann |
| 2,685,930 | A | 8/1954 | Albaugh |
| 3,497,005 | A | 2/1970 | Pelopsky |
| 3,848,671 | A | 11/1974 | Kern |
| 3,954,140 | A | 5/1976 | Hendrick |
| 3,988,036 | A | 10/1976 | Fisher |
| 3,991,091 | A | 11/1976 | Driscoll |
| 4,035,282 | A | 7/1977 | Stuchberry et al. |
| 4,042,487 | A | 8/1977 | Seguchi |
| 4,087,781 | A | 5/1978 | Grossi et al. |
| 4,136,014 | A | 1/1979 | Vermeulen |
| 4,140,179 | A | 2/1979 | Kasevich et al. |
| 4,140,180 | A | 2/1979 | Bridges et al. |
| 4,144,935 | A | 3/1979 | Bridges et al. |
| 4,146,125 | A | 3/1979 | Sanford et al. |
| 4,196,329 | A | 4/1980 | Rowland et al. |
| 4,295,880 | A | 10/1981 | Horner |
| 4,300,219 | A | 11/1981 | Joyal |
| 4,301,865 | A | 11/1981 | Kasevich et al. |

(Continued)

FOREIGN PATENT DOCUMENTS

| | | | |
|---|---|---|---|
| CA | 1199573 | A1 | 1/1986 |
| CA | 2678473 | | 8/2009 |

(Continued)

OTHER PUBLICATIONS

PCT Notification of Transmittal of the International Search Report and the Written Opinion of the International Searching Authority, or the Declaration, in PCT/US2010/025761, dated Feb. 9, 2011.

(Continued)

*Primary Examiner* — Stephen Jones
(74) *Attorney, Agent, or Firm* — Allen, Dyer, Doppelt, Milbrath & Gilchrist, P.A.

(57) ABSTRACT

A waveguide matching unit is disclosed. The waveguide matching unit includes gyrator having first and second waveguides. The first waveguide includes first and second ports that are connected by a first waveguide channel. An RF signal propagating through the first waveguide channel is phase shifted by about 90° when propagating from the first to the second port, and is phase shifted by about 0° when propagating from the second port to the first port. The second waveguide includes third and fourth ports that are connected by a second waveguide channel. An RF signal propagating through the second waveguide channel is phase shifted by about 0° when propagating from the third to the fourth port, and is phase shifted by about 90° when propagating from the fourth port to the third port.

24 Claims, 7 Drawing Sheets

U.S. PATENT DOCUMENTS

| | | | |
|---|---|---|---|
| 4,328,324 | A | 5/1982 | Kock |
| 4,373,581 | A | 2/1983 | Toellner |
| 4,396,062 | A | 8/1983 | Iskander |
| 4,404,123 | A | 9/1983 | Chu |
| 4,410,216 | A | 10/1983 | Allen |
| 4,425,227 | A | 1/1984 | Smith |
| 4,449,585 | A | 5/1984 | Bridges et al. |
| 4,456,065 | A | 6/1984 | Heim |
| 4,457,365 | A | 7/1984 | Kasevich et al. |
| 4,470,459 | A | 9/1984 | Copland |
| 4,485,869 | A | 12/1984 | Sresty |
| 4,487,257 | A | 12/1984 | Dauphine |
| 4,508,168 | A | 4/1985 | Heeren |
| 4,514,305 | A | 4/1985 | Filby |
| 4,524,827 | A | 6/1985 | Bridges |
| 4,531,468 | A | 7/1985 | Simon |
| 4,583,586 | A | 4/1986 | Fujimoto et al. |
| 4,620,593 | A | 11/1986 | Haagensen |
| 4,622,496 | A | 11/1986 | Dattili |
| 4,645,585 | A | 2/1987 | White |
| 4,678,034 | A | 7/1987 | Eastlund |
| 4,703,433 | A | 10/1987 | Sharrit |
| 4,790,375 | A | 12/1988 | Bridges |
| 4,817,711 | A | 4/1989 | Jeambey |
| 4,882,984 | A | 11/1989 | Eves, II |
| 4,892,782 | A | 1/1990 | Fisher et al. |
| 5,046,559 | A | 9/1991 | Glandt |
| 5,055,180 | A | 10/1991 | Klaila |
| 5,065,819 | A | 11/1991 | Kasevich |
| 5,082,054 | A | 1/1992 | Kiamanesh |
| 5,136,249 | A | 8/1992 | White |
| 5,199,488 | A | 4/1993 | Kasevich |
| 5,233,306 | A | 8/1993 | Misra |
| 5,236,039 | A | 8/1993 | Edelstein |
| 5,251,700 | A | 10/1993 | Nelson |
| 5,293,936 | A | 3/1994 | Bridges |
| 5,304,767 | A | 4/1994 | MacGaffigan |
| 5,315,561 | A | 5/1994 | Grossi |
| 5,370,477 | A | 12/1994 | Bunin |
| 5,378,879 | A | 1/1995 | Monovoukas |
| 5,506,592 | A | 4/1996 | MacDonald |
| 5,582,854 | A | 12/1996 | Nosaka |
| 5,621,844 | A | 4/1997 | Bridges |
| 5,631,562 | A | 5/1997 | Cram |
| 5,746,909 | A | 5/1998 | Calta |
| 5,910,287 | A | 6/1999 | Cassin |
| 5,923,299 | A | 7/1999 | Brown et al. |
| 6,045,648 | A | 4/2000 | Palmgren et al. |
| 6,046,464 | A | 4/2000 | Schetzina |
| 6,055,213 | A | 4/2000 | Rubbo |
| 6,063,338 | A | 5/2000 | Pham |
| 6,097,262 | A | 8/2000 | Combellack |
| 6,106,895 | A | 8/2000 | Usuki |
| 6,112,273 | A | 8/2000 | Kau |
| 6,184,427 | B1 | 2/2001 | Klepfer |
| 6,229,603 | B1 | 5/2001 | Coassin |
| 6,232,114 | B1 | 5/2001 | Coassin |
| 6,301,088 | B1 | 10/2001 | Nakada |
| 6,303,021 | B2 | 10/2001 | Winter |
| 6,348,679 | B1 | 2/2002 | Ryan et al. |
| 6,360,819 | B1 | 3/2002 | Vinegar |
| 6,432,365 | B1 | 8/2002 | Levin |
| 6,603,309 | B2 | 8/2003 | Forgang |
| 6,613,678 | B1 | 9/2003 | Sakaguchi |
| 6,614,059 | B1 | 9/2003 | Tsujimura et al. |
| 6,649,888 | B2 | 11/2003 | Ryan et al. |
| 6,712,136 | B2 | 3/2004 | de Rouffignac |
| 6,808,935 | B2 | 10/2004 | Levin |
| 6,923,273 | B2 | 8/2005 | Terry |
| 6,932,155 | B2 | 8/2005 | Vinegar |
| 6,967,589 | B1 | 11/2005 | Peters |
| 6,992,630 | B2 | 1/2006 | Parsche |
| 7,046,584 | B2 | 5/2006 | Sorrells |
| 7,079,081 | B2 | 7/2006 | Parsche et al. |
| 7,091,460 | B2 | 8/2006 | Kinzer |
| 7,109,457 | B2 | 9/2006 | Kinzer |
| 7,115,847 | B2 | 10/2006 | Kinzer |
| 7,138,937 | B1 * | 11/2006 | Macdonald ..... 342/42 |
| 7,147,057 | B2 | 12/2006 | Steele |
| 7,172,038 | B2 | 2/2007 | Terry |
| 7,205,947 | B2 | 4/2007 | Parsche |
| 7,312,428 | B2 | 12/2007 | Kinzer |
| 7,322,416 | B2 | 1/2008 | Burris, II |
| 7,337,980 | B2 | 3/2008 | Schaedel |
| 7,438,807 | B2 | 10/2008 | Garner et al. |
| 7,441,597 | B2 | 10/2008 | Kasevich |
| 7,461,693 | B2 | 12/2008 | Considine et al. |
| 7,484,561 | B2 | 2/2009 | Bridges |
| 7,562,708 | B2 | 7/2009 | Cogliandro |
| 7,623,804 | B2 | 11/2009 | Sone |
| 2002/0032534 | A1 | 3/2002 | Regier |
| 2004/0031731 | A1 | 2/2004 | Honeycutt |
| 2005/0199386 | A1 | 9/2005 | Kinzer |
| 2005/0274513 | A1 | 12/2005 | Schultz |
| 2006/0038083 | A1 | 2/2006 | Criswell |
| 2007/0108202 | A1 | 5/2007 | Kinzer |
| 2007/0131591 | A1 | 6/2007 | Pringle |
| 2007/0137852 | A1 | 6/2007 | Considine et al. |
| 2007/0137858 | A1 | 6/2007 | Considine et al. |
| 2007/0187089 | A1 | 8/2007 | Bridges |
| 2007/0261844 | A1 | 11/2007 | Cogliandro et al. |
| 2008/0073079 | A1 | 3/2008 | Tranquilla |
| 2008/0143330 | A1 | 6/2008 | Madio |
| 2009/0009410 | A1 | 1/2009 | Dolgin et al. |
| 2009/0242196 | A1 | 10/2009 | Pao |

FOREIGN PATENT DOCUMENTS

| | | | |
|---|---|---|---|
| DE | 10 2008 022176 | A1 | 11/2009 |
| EP | 0 135 966 | | 4/1985 |
| EP | 0418117 | A1 | 3/1991 |
| EP | 0563999 | A2 | 10/1993 |
| EP | 1106672 | A1 | 6/2001 |
| FR | 1586066 | A | 2/1970 |
| FR | 2925519 | A1 | 6/2009 |
| JP | 56050119 | A | 5/1981 |
| JP | 2246502 | A | 10/1990 |
| WO | WO 2007/133461 | | 11/2007 |
| WO | WO2008/011412 | A2 | 1/2008 |
| WO | WO 2008/030337 | | 3/2008 |
| WO | WO2008098850 | A1 | 8/2008 |
| WO | WO2009027262 | A1 | 3/2009 |
| WO | WO2009/114934 | A1 | 9/2009 |

OTHER PUBLICATIONS

PCT Notification of Transmittal of the International Search Report and the Written Opinion of the International Searching Authority, or the Declaration, in PCT/US2010/057090, dated Mar. 3, 2011.

"Control of Hazardous Air Pollutants From Mobile Sources", U.S. Environmental Protection Agency, Mar. 29, 2006. p. 15853 (http://www.epa.gov/EPA-AIR/2006/March/Day-29/a2315b.htm).

Von Hippel, Arthur R., Dielectrics and Waves, Copyright 1954, Library of Congress Catalog Card No. 54-11020, Contents, pp. xi-xii; Chapter II, Section 17, "Polyatomic Molecules", pp. 150-155; Appendix C-E, pp. 273-277, New York, John Wiley and Sons.

United States Patent and Trademark Office, Non-final Office action issued in U.S. Appl. No. 12/396,247, dated Mar. 28, 2011.

United States Patent and Trademark Office, Non-final Office action issued in U.S. Appl. No. 12/396,284, dated Apr. 26, 2011.

Patent Cooperation Treaty, Notification of Transmittal of the International Search Report and the Written Opinion of the International Searching Authority, or the Declaration, in PCT/US2010/025808, dated Apr. 5, 2011.

Deutsch, C.V., McLennan, J.A., "The Steam Assisted Gravity Drainage (SAGD) Process," Guide to SAGD (Steam Assisted Gravity Drainage) Reservoir Characterization Using Geostatistics, Centre for Computational Statistics (CCG), Guidebook Series, 2005, vol. 3; p. 2, section 1.2, published by Centre for Computational Statistics, Edmonton, AB, Canada.

Marcuvitz, Nathan, Waveguide Handbook; 1986; Institution of Engineering and Technology, vol. 21 of IEE Electromagnetic Wave series, ISBN 0863410588, Chapter 1, pp. 1-54, published by Peter Peregrinus Ltd. on behalf of the Institution of Electrical Engineers, © 1986.

Marcuvitz, Nathan, Waveguide Handbook; 1986; Institution of Engineering and Technology, vol. 21 of IEE Electromagnetic Wave series, ISBN 0863410588, Chapter 2.3, pp. 66-72, published by Peter Peregrinus Ltd. on behalf of the Institution of Electrical Engineers, © 1986.
"Oil sands." Wikipedia, the free encyclopedia. Retrieved from the Internet from: http://en.wikipedia.org/w/index.php?title=Oil_sands &printable=yes, Feb. 16, 2009.
Sahni et al., "Electromagnetic Heating Methods for Heavy Oil Reservoirs." 2000 Society of Petroleum Engineers SPE/AAPG Western Regional Meeting, Jun. 19-23, 2000.
Power et al., "Froth Treatment: Past, Present & Future." Oil Sands Symposium, University of Alberta, May 3-5, 2004.
Flint, "Bitumen Recovery Technology a Review of Long Term R&D Opportunities." Jan. 31, 2005. LENEF Consulting (1994) Limited.
"Froth Flotation." Wikipedia, the free encyclopedia. Retrieved from the internet from: http://en.wikipedia.org/wiki/Froth_flotation, Apr. 7, 2009.
"Relative static permittivity." Wikipedia, the free encyclopedia. Retrieved from the Internet from http://en.wikipedia.org/w/index/php?title=Relative_static_permittivity&printable=yes, Feb. 12, 2009.
"Tailings." Wikipedia, the free encyclopedia. Retrieved from the Internet from http://en.wikipedia.org/w/index.php?title=Tailings &printable=yes, Feb. 12, 2009.
"Technologies for Enhanced Energy Recovery" Executive Summary, Radio Frequency Dielectric Heating Technologies for Conventional and Non-Conventional Hydrocarbon-Bearing Formulations, Quasar Energy, LLC, Sep. 3, 2009, pp. 1-6.
Burnhan, "Slow Radio-Frequency Processing of Large Oil Shale Volumes to Produce Petroleum-like Shale Oil," U.S. Department of Energy, Lawrence Livermore National Laboratory, Aug. 20, 2003, UCRL-ID-155045.
Sahni et al., "Electromagnetic Heating Methods for Heavy Oil Reservoirs," U.S. Department of Energy, Lawrence Livermore National Laboratory, May 1, 2000, UCL-JC-138802.
Abernethy, "Production Increase of Heavy Oils by Electromagnetic Heating," The Journal of Canadian Petroleum Technology, Jul.-Sep. 1976, pp. 91-97.
Sweeney, et al., "Study of Dielectric Properties of Dry and Saturated Green River Oil Shale," Lawrence Livermore National Laboratory, Mar. 26, 2007, revised manuscript Jun. 29, 2007, published on Web Aug. 25, 2007.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-18.
Kinzer, "Past, Present, and Pending Intellectual Property for Electromagnetic Heating of Oil Shale," Quasar Energy LLC, 28th Oil Shale Symposium Colorado School of Mines, Oct. 13-15, 2008, pp. 1-33.
A. Godio. "Open ended-coaxial Cable Measurements of Saturated Sandy Soils", American Journal of Environmental Sciences, vol. 3, No. 3, 2007, pp. 175-182, XP002583544.
Carlson et al., "Development of the I IT Research Institute RF Heating Process for In Situ Oil Shale/Tar Sand Fuel Extraction—An Overview", Apr. 1981.
PCT International Search Report and Written Opinion in PCT/US2010/025763, Jun. 4, 2010.
PCT International Search Report and Written Opinion in PCT/US2010/025807, Jun. 17, 2010.
PCT International Search Report and Written Opinion in PCT/US2010/025804, Jun. 30, 2010.
PCT International Search Report and Written Opinion in PCT/US2010/025769, Jun. 10, 2010.
PCT International Search Report and Written Opinion in PCT/US2010/025765, Jun. 30, 2010.
PCT International Search Report and Written Opinion in PCT/US2010/025772, Aug. 9, 2010.
U.S. Appl. No. 12/886,338, filed Sep. 20, 2010 (unpublished).
Butler, R.M. "Theoretical Studies on the Gravity Drainage of Heavy Oil During In-Situ Steam Heating", Can J. Chem Eng, vol. 59, 1981.
Butler, R. and Mokrys, I., "A New Process (VAPEX) for Recovering Heavy Oils Using Hot Water and Hydrocarbon Vapour", Journal of Canadian Petroleum Technology, 30(1), 97-106, 1991.
Butler, R. and Mokrys, I., "Recovery of Heavy Oils Using Vapourized Hydrocarbon Solvents: Further Development of the VAPEX Process", Journal of Canadian Petroleum Technology, 32(6), 56-62, 1993.
Butler, R. and Mokrys, I., "Closed Loop Extraction Method for the Recovery of Heavy Oils and Bitumens Underlain by Aquifers: the VAPEX Process", Journal of Canadian Petroleum Technology, 37(4), 41-50, 1998.
Das, S.K. and Butler, R.M., "Extraction of Heavy Oil and Bitumen Using Solvents at Reservoir Pressure" CIM 95-118, presented at the CIM 1995 Annual Technical Conference in Calgary, Jun. 1995.
Das, S.K. and Butler, R.M., "Diffusion Coefficients of Propane and Butane in Peace River Bitumen" Canadian Journal of Chemical Engineering, 74, 988-989, Dec. 1996.
Das, S.K. and Butler, R.M., "Mechanism of the Vapour Extraction Process for Heavy Oil and Bitumen", Journal of Petroleum Science and Engineering, 21, 43-59, 1998.
Dunn, S.G., Nenniger, E. and Rajan, R., "A Study of Bitumen Recovery by Gravity Drainage Using Low Temperature Soluble Gas Injection", Canadian Journal of Chemical Engineering, 67, 978-991, Dec. 1989.
Frauenfeld, T., Lillico, D., Jossy, C., Vilcsak, G., Rabeeh, S. and Singh, S., "Evaluation of Partially Miscible Processes for Alberta Heavy Oil Reservoirs", Journal of Canadian Petroleum Technology, 37(4), 17-24, 1998.
Mokrys, I., and Butler, R., "In Situ Upgrading of Heavy Oils and Bitumen by Propane Deasphalting: The VAPEX Process", SPE 25452, presented at the SPE Production Operations Symposium held in Oklahoma City OK USA, Mar. 21-23, 1993.
Nenniger, J.E. and Dunn, S.G., "How Fast is Solvent Based Gravity Drainage?", CIPC 2008-139, presented at the Canadian International Petroleum Conference, held in Calgary, Alberta Canada, Jun. 17-19, 2008.
Nenniger, J.E. and Gunnewick, L., "Dew Point vs. Bubble Point: A Misunderstood Constraint on Gravity Drainage Processes", CIPC 2009-065, presented at the Canadian International Petroleum Conference, held in Calgary, Alberta Canada, Jun. 16-18, 2009.
Bridges, J.E., Sresty, G.C., Spencer, H.L. and Wattenbarger, R.A., "Electromagnetic Stimulation of Heavy Oil Wells", 1221-1232, Third International Conference on Heavy Oil Crude and Tar Sands, UNITAR/UNDP, Long Beach California, USA Jul. 22-31, 1985.
Carrizales, M.A., Lake, L.W. and Johns, R.T., "Production Improvement of Heavy Oil Recovery by Using Electromagnetic Heating", SPE115723, presented at the 2008 SPE Annual Technical Conference and Exhibition held in Denver, Colorado, USA, Sep. 21-24, 2008.
Carrizales, M. and Lake, L.W., "Two-Dimensional COMSOL Simulation of Heavy-Oil Recovery by Electromagnetic Heating", Proceedings of the COMSOL Conference Boston, 2009.
Chakma, A. and Jha, K.N., "Heavy-Oil Recovery from Thin Pay Zones by Electromagnetic Heating", SPE24817, presented at the 67th Annual Technical Conference and Exhibition of the Society of Petroleum Engineers held in Washington, DC, Oct. 4-7, 1992.
Chhetri, A.B. and Islam, M.R., "A Critical Review of Electromagnetic Heating for Enhanced Oil Recovery", Petroleum Science and Technology, 26(14), 1619-1631, 2008.
Chute, F.S., Vermeulen, F.E., Cervenan, M.R. and McVea, F.J., "Electrical Properties of Athabasca Oil Sands", Canadian Journal of Earth Science, 16, 2009-2021, 1979.
Davidson, R.J., "Electromagnetic Stimulation of Lloydminster Heavy Oil Reservoirs", Journal of Canadian Petroleum Technology, 34(4), 15-24, 1995.
Hu, Y., Jha, K.N. and Chakma, A., "Heavy-Oil Recovery from Thin Pay Zones by Electromagnetic Heating", Energy Sources, 21(1-2), 63-73, 1999.
Kasevich, R.S., Price, S.L., Faust, D.L. and Fontaine, M.F., "Pilot Testing of a Radio Frequency Heating System for Enhanced Oil Recovery from Diatomaceous Earth", SPE28619, presented at the SPE 69th Annual Technical Conference and Exhibition held in New Orleans LA, USA, Sep. 25-28, 1994.

Koolman, M., Huber, N., Diehl, D. and Wacker, B., "Electromagnetic Heating Method to Improve Steam Assisted Gravity Drainage", SPE117481, presented at the 2008 SPE International Thermal Operations and Heavy Oil Symposium held in Calgary, Alberta, Canada, Oct. 20-23, 2008.

Kovaleva, L.A., Nasyrov, N.M. and Khaidar, A.M., Mathematical Modelling of High-Frequency Electromagnetic Heating of the Bottom-Hole Area of Horizontal Oil Wells, Journal of Engineering Physics and Thermophysics, 77(6), 1184-1191, 2004.

McGee, B.C.W. and Donaldson, R.D., "Heat Transfer Fundamentals for Electro-thermal Heating of Oil Reservoirs", CIPC 2009-024, presented at the Canadian International Petroleum Conference, held in Calgary, Alberta, Canada Jun. 16-18, 2009.

Ovalles, C., Fonseca, A., Lara, A., Alvarado, V., Urrecheaga, K, Ranson, A. and Mendoza, H., "Opportunities of Downhole Dielectric Heating in Venezuela: Three Case Studies Involving Medium, Heavy and Extra-Heavy Crude Oil Reservoirs" SPE78980, presented at the 2002 SPE International Thermal Operations and Heavy Oil Symposium and International Horizontal Well Technology Conference held in Calgary, Alberta, Canada, Nov. 4-7, 2002.

Rice, S.A., Kok, A.L. and Neate, C.J., "A Test of the Electric Heating Process as a Means of Stimulating the Productivity of an Oil Well in the Schoonebeek Field", CIM 92-04 presented at the CIM 1992 Annual Technical Conference in Calgary, Jun. 7-10, 1992.

Sahni, A. and Kumar, M. "Electromagnetic Heating Methods for Heavy Oil Reservoirs", SPE62550, presented at the 2000 SPE/AAPG Western Regional Meeting held in Long Beach, California, Jun. 19-23, 2000.

Sayakhov, F.L., Kovaleva, L.A. and Nasyrov, N.M., "Special Features of Heat and Mass Exchange in the Face Zone of Boreholes upon Injection of a Solvent with a Simultaneous Electromagnetic Effect", Journal of Engineering Physics and Thermophysics, 71(1), 161-165, 1998.

Spencer, H.L., Bennett, K.A. and Bridges, J.E. "Application of the IITRI/Uentech Electromagnetic Stimulation Process to Canadian Heavy Oil Reservoirs" Paper 42, Fourth International Conference on Heavy Oil Crude and Tar Sands, UNITAR/UNDP, Edmonton, Alberta, Canada, Aug. 7-12, 1988.

Sresty, G.C., Dev, H., Snow, R.H. and Bridges, J.E., "Recovery of Bitumen from Tar Sand Deposits with the Radio Frequency Process", SPE Reservoir Engineering, 85-94, Jan. 1986.

Vermulen, F. and McGee, B.C.W., "In Situ Electromagnetic Heating for Hydrocarbon Recovery and Environmental Remediation", Journal of Canadian Petroleum Technology, Distinguished Author Series, 39(8), 25-29, 2000.

Schelkunoff, S.K. and Friis, H.T., "Antennas: Theory and Practice", John Wiley & Sons, Inc., London, Chapman Hall, Limited, pp. 229-244, 351-353, 1952.

Gupta, S.C., Gittins, S.D., "Effect of Solvent Sequencing and Other Enhancement on Solvent Aided Process", Journal of Canadian Petroleum Technology, vol. 46, No. 9, pp. 57-61, Sep. 2007.

* cited by examiner

WAVEGUIDE MATCHING UNIT HAVING GYRATOR

STATEMENT REGARDING FEDERALLY SPONSORED RESEARCH OR DEVELOPMENT

[Not Applicable]

CROSS REFERENCE TO RELATED APPLICATIONS

This specification is related to U.S. Ser. Nos.:
12/839,927
12/878,774
12/820,977
12/835,331
12/886,338
filed on or about the same date as this specification, each of which is incorporated by reference here.

This specification is also related to U.S. Ser. Nos:
12/396,284
12/396,247
12/396,192
12/396,057
12/396,021
12/395,995
12/395,953
12/395,945
filed previously, each of which is incorporated by reference here.

BACKGROUND OF THE INVENTION

Radio frequency ("RF") energy, also known as electromagnetic energy, is used in a wide range of applications. Systems employing RF energy may include, for example, a source and a load receiving RF energy from the source. Some systems use the RF energy to heat a material. In such systems the load may be in the form of a susceptor that converts the RF energy to heat. Further, such systems often use electromagnetic energy at microwave frequencies.

Matching the output impedance of the source with the input impedance of the load may provide efficient transfer of RF energy to the load. When the impedances are mismatched, RF energy is reflected back from the load to the RF source. However, such impedance matching may be difficult to implement in systems having a load with an unknown and/or time varying impedance.

In systems where the load impedance is unknown or varies with time an isolator may be used between the RF energy source and the load to prevent the reflected energy from returning to the source. However, when the mismatch is mitigated with such an isolator, the reflected RF energy is dissipated in a local dummy load and, thus, is wasted. In high power systems, the dissipation of this wasted power may be substantial and give rise to cooling issues that may increase the cost of manufacturing and operating the system.

SUMMARY OF THE INVENTION

A waveguide matching unit is disclosed. The waveguide matching unit includes a gyrator having first and second waveguides. The first waveguide includes first and second ports that are connected by a first waveguide channel. An RF signal propagating through the first waveguide channel is phase shifted by about 90° when propagating from the first to the second port, and is phase shifted by about 0° when propagating from the second port to the first port. The second waveguide includes third and fourth ports that are connected by a second waveguide channel. An RF signal propagating through the second waveguide channel is phase shifted by about 0° when propagating from the third to the fourth port, and is phase shifted by about 90° when propagating from the fourth port to the third port.

DETAILED DESCRIPTION OF THE PREFERRED EMBODIMENTS

Figure 1:
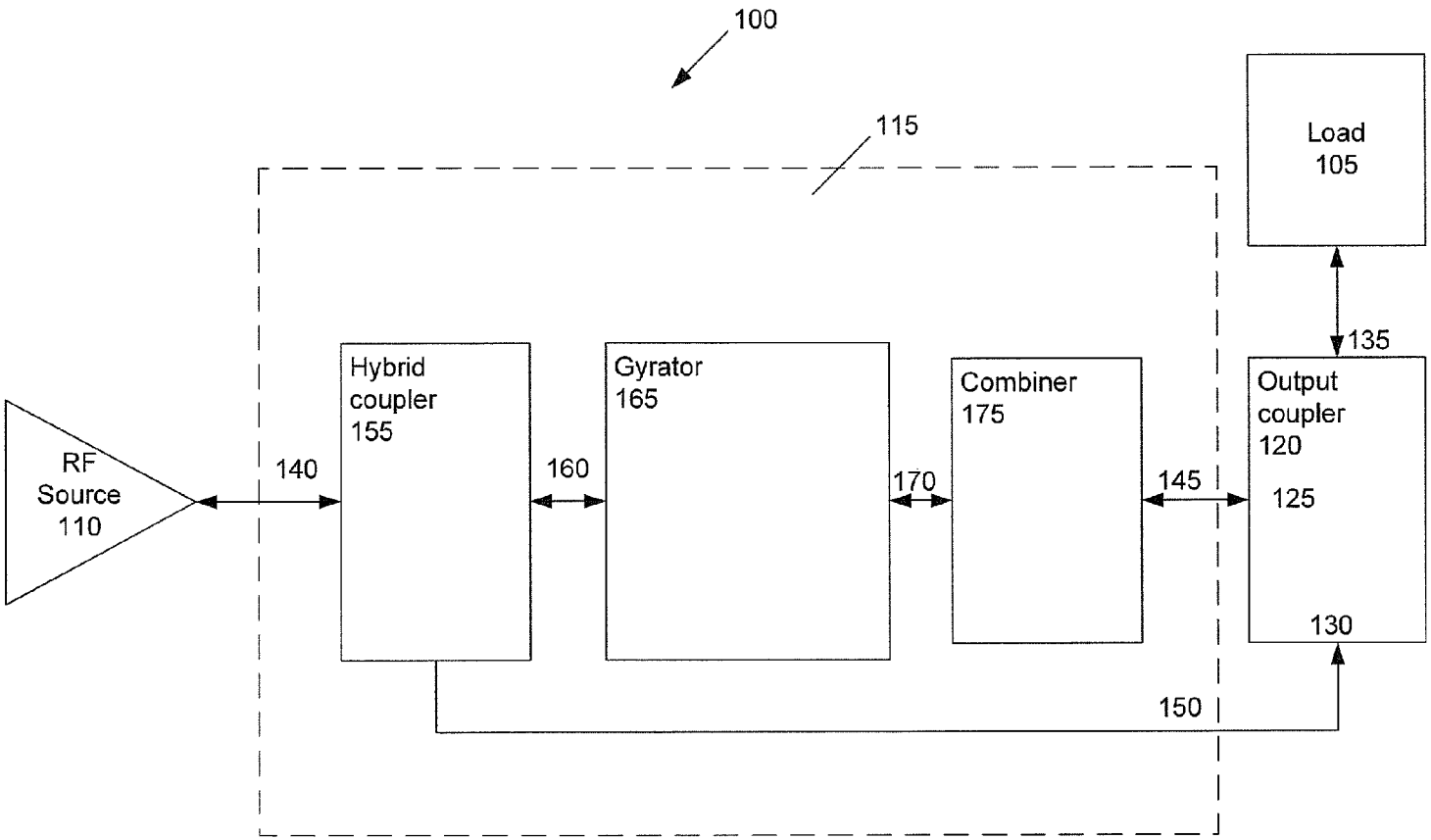
FIG. 1 is a system that provides RF energy from a source to a load.

FIG. 1 is a diagram of a radio frequency (RF) system 100 that provides an RF signal to a load 105. System 100 includes an RF source 110, a waveguide matching unit 115, and an output coupler 120. The output coupler includes a first port 125, a second port, 130, and a third port number 135. Similarly, the waveguide matching unit 115 includes a first port 140, a second port 130, and a third port 135. The first port 140 of the waveguide matching unit 115 receives an RF signal provided by source 110. The waveguide matching unit 115 phase shifts the RF signal received from the source 110 by about 90° to provide a phase shifted RF signal at the second port 145 of the matching unit 115. The phase shifted RF signal is provided to the first port 125 of the output coupler 120.

RF signals provided to the load 105 at port 135 of the output coupler 120 are both absorbed and reflected by the load 105. Power absorption and reflection is dependent on the impedance of the load 105 and, in particular, matching of the load impedance with the output impedance of output coupler 120. Reflected RF signals are returned from the load 105 to the third port 135 of the output coupler 120. The reflected RF signals received by the output coupler 120 are passed to the waveguide matching unit 115 from the first port 125 of the output coupler 120 to the second port 145 of the waveguide matching unit 115. The waveguide matching unit 115 phase shifts the reflected RF signal received at port 145 by about 90°. The reflected RF signal, now shifted by about 90°, is provided as a reflected RF feedback signal from the third port 150 of the waveguide matching unit 115 to the second port 130 of the output coupler 120.

In FIG. 1, the waveguide matching unit 115 includes a hybrid coupler 155, such as a 90° hybrid coupler, receiving an RF input signal from port 140. The hybrid coupler 155 provides first and second orthogonal RF signals at ports 160 that are generated from the RF signal at port 140. A gyrator 165 receives the first and second orthogonal signals from the hybrid coupler and operates to orthogonal the phase shift the first and second orthogonal RF signals to provide third and fourth orthogonal RF signals at ports 170. A combiner 175, such as a Magic T combiner, combines the third and fourth orthogonal RF signals received at ports 170 and provides the resulting combined RF signal at port 145.

RF power reflected from load 105 is returned from the load 105 to port 145 of the waveguide matching unit 115. These reflected RF signals, in turn, are returned to the gyrator 165 at ports 170 and, therefrom, to the hybrid coupler 155 at port 160. The gyrator 165 and hybrid coupler 155 execute phase shifting operations on the reflected RF signal received at combiner 175 to generate a reflected RF feedback signal at port 150 of the waveguide matching unit 115 for provision to the second port 130 of the output coupler 120. The output coupler 120 combines the power of the forward path RF output signal at port 125 with the power of the reflected RF feedback signal at port 130 so that the power of both the forward RF signal and the reflected RF signal are provided to the load 105. Still further, the phase shifting operations executed by the waveguide matching unit 115 substantially minimize the amount of RF power reflected back to the RF source 110 from the load 105. Instead, substantially all of the reflected energy is provided at port 150 of the waveguide matching unit 115 while substantially little of the reflected energy is directed back to the RF source 110.

Figure 2:
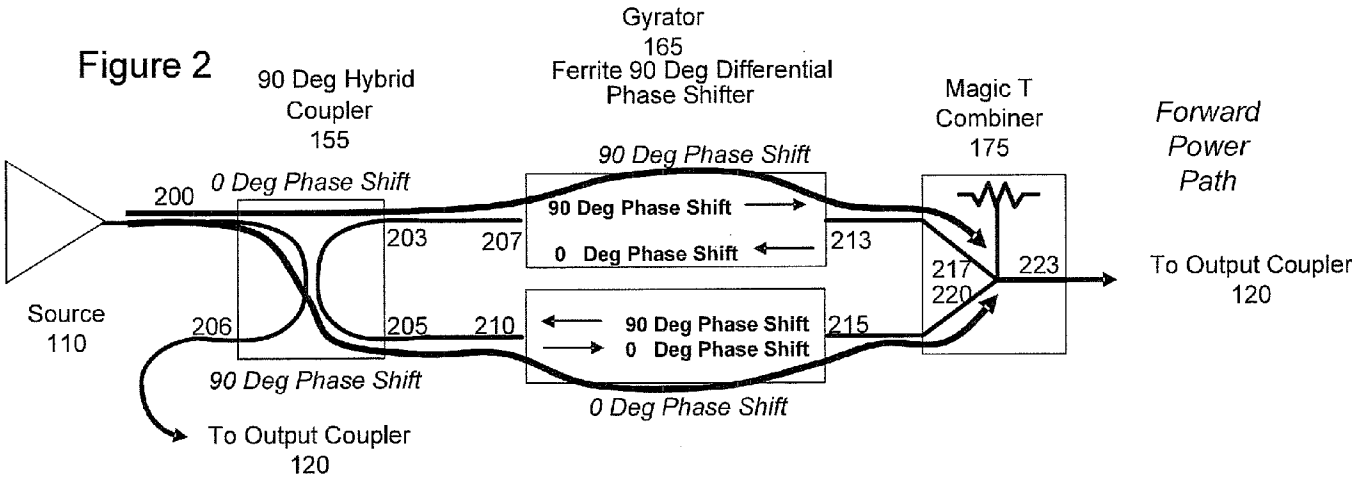
FIG. 2 shows the propagation of an RF signal along a forward power path of the waveguide matching unit of FIG. 1.
Figure 3:
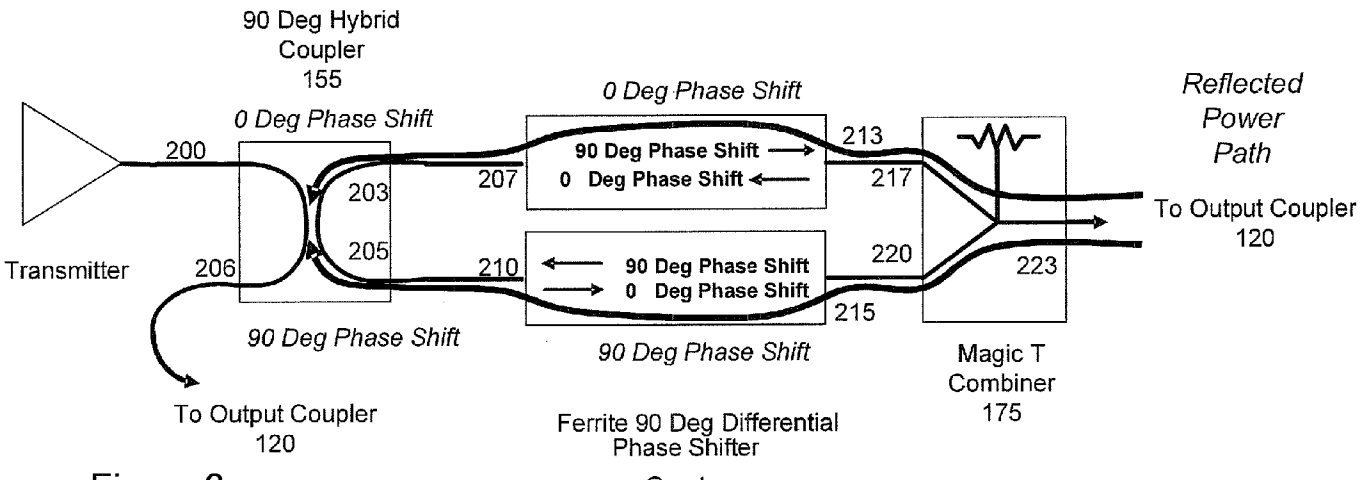
FIG. 3 shows the propagation of an RF signal along a reflected power path of the waveguide matching unit of FIG. 1.

FIGS. 2 and 3 show signal flow through the waveguide matching unit 115 of system 100. The forward power path is illustrated in FIG. 2 while the reflected power path is illustrated in FIG. 3.

With reference to FIG. 2, the hybrid coupler 155 includes a first port 200, a second port 203, a third port 205, and a fourth port 206. The RF signal from source 110 is provided to the first port 200 and results in orthogonal RF signals at ports 203 and 205. In this example, the phase of the RF signal at port 203 is substantially the same as the phase of the RF signal at port 200, and the phase of the RF signal at port 205 is about 90° phase shifted from the signal at port 205.

The gyrator 165 of FIGS. 2 and 3 is a ferrite 90° differential phase shifter having a first port 207 a second port 210, a third port 213, and a fourth port 215. The gyrator 165 operates to differentially phase shift signals RF signals propagating through the gyrator 165 based on whether the signals are in the forward or reflected power path. With respect to the forward power path shown in FIG. 2, the RF signal at port 203 of the hybrid coupler 155 is provided to port 207 of the gyrator 165. Signals propagating in the forward direction between ports 207 and 213 are phase shifted by about 90° while signals propagating in the forward direction between ports 210 and 215 are not phase shifted. The phase shifted signal at port 213 is provided to port 217 of Magic T combiner 175. The signal at port 215 is provided to port 220 of the Magic T combiner 175. This results in an output signal at port 223 of the Magic T combiner 175 in a forward direction that is a combination of both the phase shifted and non-phase shifted forward propagated RF signals provided from the gyrator 165. In the exemplary system, output signal at port 223 is provided to port 125 of the output coupler 120 (FIG. 1).

FIG. 2 illustrates propagation of power returned from the load 105 through the reflected power path. In FIG. 2, reflected power is provided from the output coupler 120 to port 223 of the Magic T combiner 175. The reflected RF signal power is evenly divided between ports 217 and 220 and provided to ports 213 and 215, respectively. Since the reflected RF signals flow through the gyrator 165 in a direction opposite the forward propagating RF signals, the gyrator 165 operates to perform a different phase shifting operation. As shown, the reflected RF signals propagating from port 213 to port 207 are not phase shifted while RF signals propagating between port 215 and port 210 are phase shifted by about 90°. The non-phase shifted RF signal is provided to port 203 of the hybrid coupler 155 and the phase shifted RF signal is provided to port 205. The phase shifted RF signal provided to port 203 is again phase shifted by the hybrid coupler 155 by about 90° and provided to port 207. No further phase shifting of the RF signal occurs between ports 203 and port 207. Similarly, the non-phase shifted RF signal provided to port 205 is phase shifted by hybrid coupler 155 by about 90° and provided at port 200. No further phase shifting of the RF signal occurs between ports 205 and 206. RF signals from port 206 are provided to port 130 of the output coupler 120 (FIG. 1).

When the forward and reflected RF signals propagate through the illustrated components in the foregoing manner, the RF signal from port 207 of the hybrid coupler 155 and the RF signal from port 223 of the Magic T combiner 175 may be provided to the output coupler 120 to generate the output signal to the load 105. The power provided at port 223 has a power magnitude that closely corresponds to the magnitude of the power of the RF signal provided from the source 110. Additionally, substantially all of the reflected power is provided from port 207 of the hybrid coupler 155 and returned to the output coupler 120 from port 206 of the hybrid coupler 155.

Figure 4:
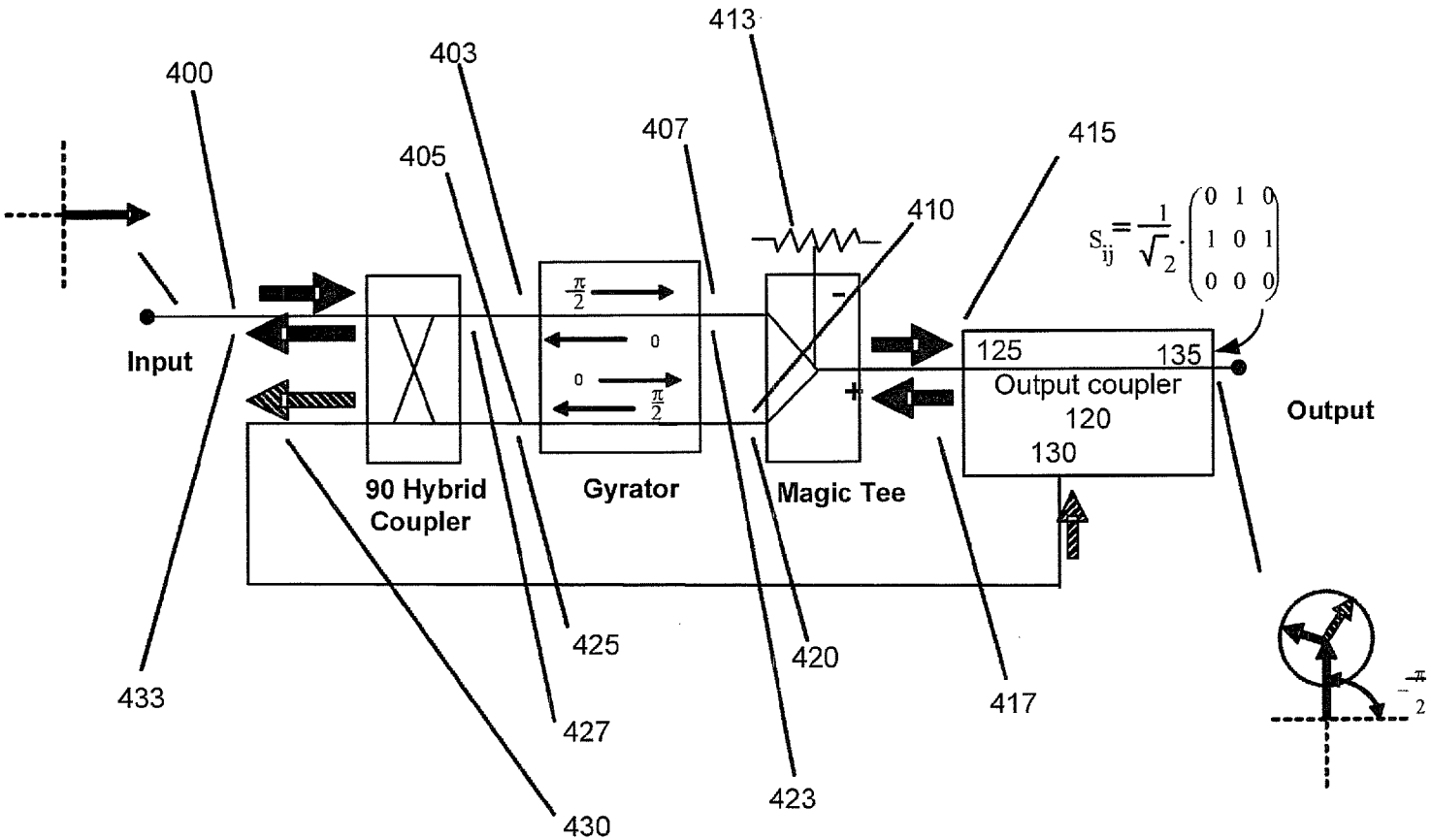
FIG. 4 is a block diagram used to show the relationship between power phasors in the waveguide matching unit and output coupler of FIG. 1.

FIG. 4 show some of the components of the RF system 100 with certain nodes identified in the forward power propagation path and other nodes identified for the reflected power propagation path. Nodes 400, 403, 405, 407, 410, 413, and 415 are associated with the forward power propagation path through the waveguide matching unit 115. The power phasors at each of the forward power propagation nodes are set forth in Table 1. The magnitude and angle of the power phasors in Table 1 are based on the assumption that the power of the RF signal from source 110 at node 400 is $1\angle 0$.

TABLE 1

POWER PHASORS ALONG FORWARD PROPAGATION PATH

| Node | Power Phasor (Angle and Magnitude) |
|---|---|
| 400 | $1\angle 0$ |
| 403 | $\frac{1}{\sqrt{2}}\angle 0$ |
| 405 | $\frac{1}{\sqrt{2}}\angle -\frac{\pi}{2}$ |
| 407 | $\frac{1}{\sqrt{2}}\angle -\frac{\pi}{2}$ |
| 410 | $\frac{1}{\sqrt{2}}\angle -\frac{\pi}{2}$ |

TABLE 1-continued

| POWER PHASORS ALONG FORWARD PROPAGATION PATH | |
|---|---|
| Node | Power Phasor (Angle and Magnitude) |
| 413 | $\left(\frac{1}{2}\angle -\frac{\pi}{2}\right)-\left(\frac{1}{2}\angle -\frac{\pi}{2}\right)=0$ |
| 415 | Combined Power at Nodes 407 and 410 Provided at Output of Waveguide Matching Unit $\left(\frac{1}{2}\angle -\frac{\pi}{2}\right)+\left(\frac{1}{2}\angle -\frac{\pi}{2}\right)=1\angle -\frac{\pi}{2}$ |

As shown in Table 1, the RF power of the signals at nodes 407 and 410 are combined at the output of the waveguide matching unit 115. This results in an output signal of $$1\angle -\frac{\pi}{2}.$$

Consequently, substantially all of the power provided at node 400 propagates along the forward propagation path to node 415, but is phase shifted by $$\frac{\pi}{2}.$$

Nodes 417, 420, 423, 425, 427, 430, and 433 are associated with the reflected power propagation path through the waveguide matching unit 115. The power phasors at each of the reflected power propagation nodes are set forth in Table 2. The magnitude and angle of the power phasors in Table 2 are provided based on the assumption that the power of the RF signal returned to node 417 is $1\angle 0$.

TABLE 2

| POWER PHASORS ALONG REFLECTED PROPAGATION PATH | |
|---|---|
| Node | Power Phasor (Angle and Magnitude) |
| 417 | $1\angle 0$ |
| 420 | $\frac{1}{\sqrt{2}}\angle 0$ |
| 423 | $\frac{1}{\sqrt{2}}\angle 0$ |
| 425 | $\frac{1}{\sqrt{2}}\angle -\frac{\pi}{2}$ |
| 427 | $\frac{1}{\sqrt{2}}\angle 0$ |
| 430 | $\left(\frac{1}{\sqrt{2}}\angle -\frac{\pi}{2}\right)-\left(\frac{1}{\sqrt{2}}\angle -\frac{\pi}{2}\right)=0$ |
| 433 | Total Reflected Power Returned to Source $\left(\frac{1}{2}\angle -0\right)-\left(\frac{1}{2}\angle -\pi\right)=0$ |

TABLE 2-continued

| POWER PHASORS ALONG REFLECTED PROPAGATION PATH | |
|---|---|
| Node | Power Phasor (Angle and Magnitude) |
| 435 | Reflected Power Returned to Output Coupler 120 $\left(\frac{1}{2}\angle -\frac{\pi}{2}\right)+\left(\frac{1}{2}\angle -\frac{\pi}{2}\right)=1\angle -\frac{\pi}{2}$ |

As shown in Table 2, the power of the reflected RF signal returned to the source 110 has been minimized. In the illustrated example, the total reflected power is 0. Also, substantially all of the reflected power is returned to the output coupler 120. Here, the power returned to the output coupler 120 is approximately $$1\angle -\frac{\pi}{2}.$$

The output coupler 120 may be implemented in a number of different manners. For example, it may be in the form of a 90° hybrid coupler having one of its ports connected to a $$\frac{\lambda}{4}$$

stub that provides an infinite impedance at that port. Such a coupler 120 may be designed as a three port device having the following scatter matrix characteristics:

$$S_{ij}=\frac{1}{\sqrt{2}}\begin{pmatrix}0 & 1 & 0\\ 1 & 0 & 1\\ 0 & 0 & 0\end{pmatrix}$$

The scatter matrix may alternatively be designed to have the following characteristics:

$$S_{ij}=\frac{1}{\sqrt{2}}\begin{pmatrix}0 & 1 & 0\\ 1 & 0 & j\\ 0 & 0 & 0\end{pmatrix}$$

The waveguide matching unit 115 may be implemented as a generally integrated unit using passive components. Generally stated, the waveguide matching unit 115 may be formed from one or more pole pieces, one or more ferrite strips, one or more magnets, and at least one body portion. Waveguide channels may be disposed along the length of the body portion. The pole pieces, ferrite strips, and magnets may be supported by the body portion and disposed about the waveguide channels to achieve the desired propagation characteristics.

Figure 5:
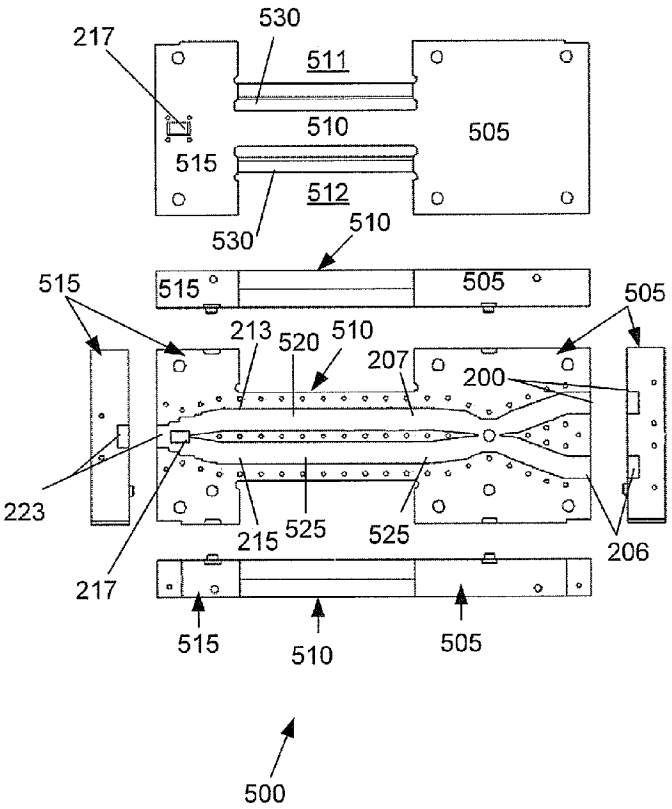
FIG. 5 provides multiple views of a first body half used in the implementation of the waveguide matching unit.

Multiple views of one half of a body portion 500 are shown in FIG. 5. Body portion half 500 may be functionally viewed as three components. Section 505 corresponds to the hybrid coupler 155 and includes ports 200 and 207 for connection to components external to the waveguide matching unit 115. Section 510 corresponds to gyrator 165 and includes ports 207 and 210 respectively associated with waveguide channels 520 and 525. Section 515 corresponds to the Magic T combiner 175 and includes ports 213, 220, and 223.

Figure 6:
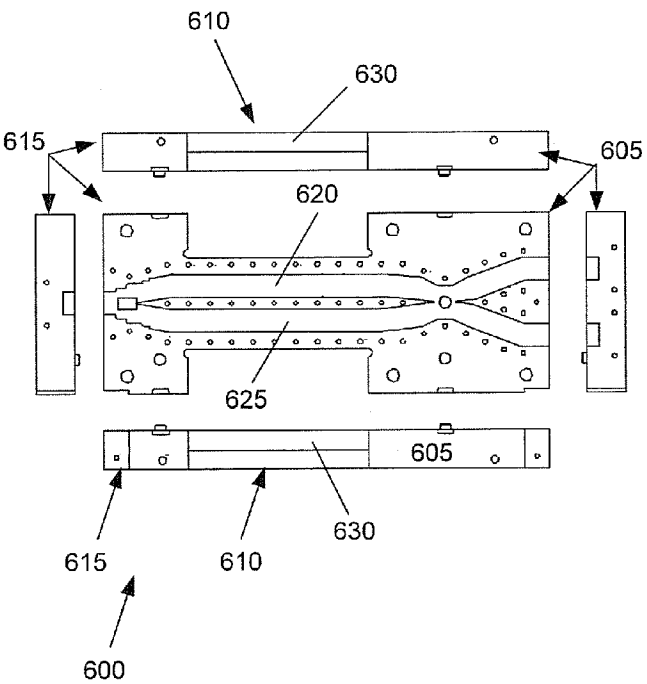
FIG. 6 provides multiple views of a second body half used in the implementation of the waveguide matching unit.

Multiple views of another half of a body portion 600 are shown in FIG. 6. Body portion half 600 has sections that cover corresponding sections of body portion half 500. As shown in FIG. 6, section 605 is disposed to overlie section 505 of body portion half 500. Section 615 is disposed to overlie section 515 of body portion half 500. Section 610 is disposed to overlie section 510 of body portion half 500 and includes a pair of waveguide channels 620 and 625 that overlie channels 520 and 525 when the body portion halves 500 and 600 are joined with one another. A plurality of apertures are disposed through each half 500 and 600 to facilitate alignment and connection of the halves with one another. In the illustrated example, a number of the apertures are proximate the waveguide channels to prevent leakage of RF power from the waveguide matching unit 115 as well as to ensure proper operation of each functional section.

The gyrator sections 510 and 610 include grooves 530 and 630 that are formed to accept pole pieces and magnets. These components are generally disposed proximate the gyrator sections 510 and 610 and facilitate providing the static magnetic field used, at least in part, to cause the phase shifting operations executed by the gyrator 165.

Figure 7:
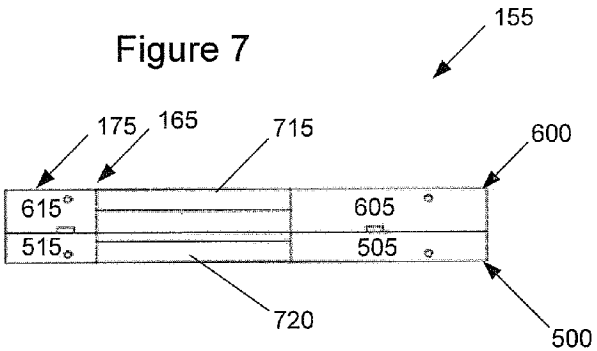
FIG. 7 is a side view of the assembled waveguide matching unit.

FIG. 7 shows the body portion halves 500 and 600 connected to one another along with magnet 705 as well as pole pieces 715 and 720 disposed in the channels formed by grooves 530 and 630. In this example, the waveguide matching unit 115 is formed as a generally integrated structure from passive components. Body portion halves 500 and 600 may be formed from copper that has been electroplated with silver.

Figure 8:
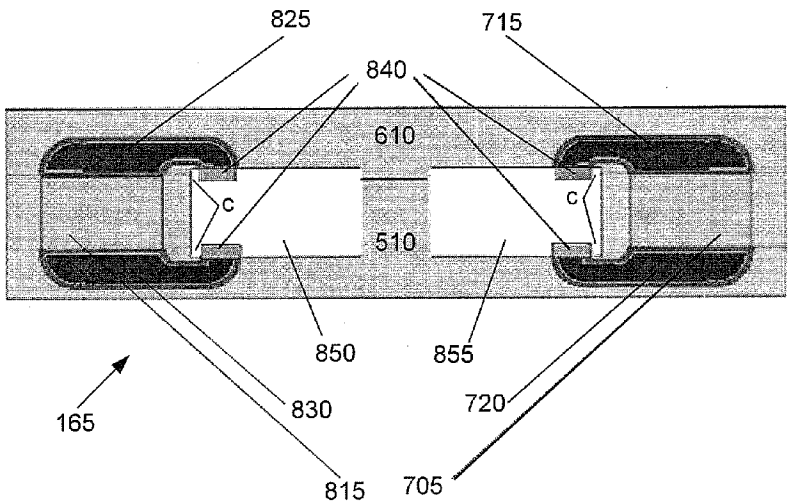
FIG. 8 is a simplified cross-sectional view through the gyrator portion of the waveguide matching unit of FIG. 7.

FIG. 8 is a simplified cross-sectional view through the gyrator 165 of FIG. 7. As illustrated, the gyrator 165 includes rectangular waveguide channels 850 and 855 that are generally adjacent one another. Each waveguide channel 850 and 855 is associated with a corresponding magnet 815 and 830 as well as upper and lower pole pieces 715, 720 and 825, 815. Poll pieces 715 and 720 direct the magnetic field of magnet 705 into the waveguide channel 855. Poll pieces 825 and 830 direct the magnetic field of magnet 815 into the waveguide channel 850. Ferrite strips 840 are disposed at end portions of each pole piece 715, 720, 815, and 825 and overlie side regions of each waveguide channel 850 and 855 as opposed pairs. Each ferrite strip pair is associated with a respective waveguide channel 805, 810. The end portions of each pole piece 715, 720, 830, and 825 support respective pole pieces 840 and a distance c from the side wall of the corresponding waveguide channel 850 and 855. The ferrite strips 840 may be formed from compounds of metallic oxides such as those of Fe, Zn, Mn, Mg, Co, and Ni. The magnetic properties of such ferrite materials may be controlled by means of an external magnetic field. They may be transparent, reflective, absorptive, or cause wave rotation depending on the H-field.

Figure 9:
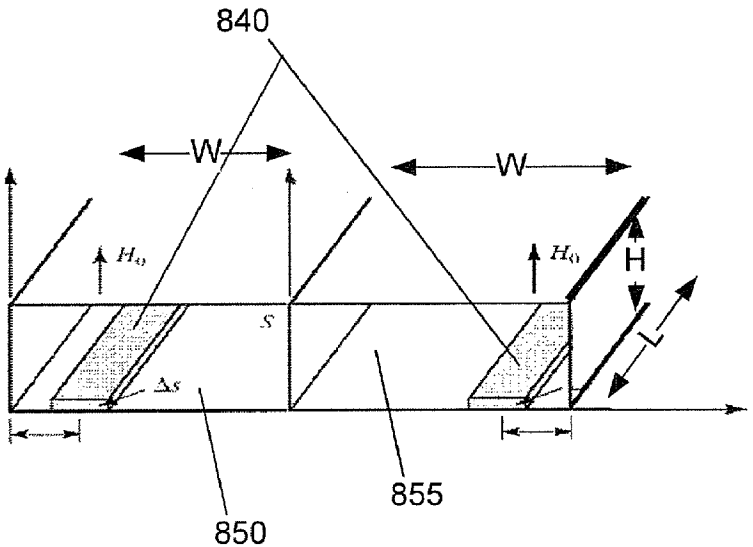
FIG. 9 schematically illustrates the rectangular waveguide channels as well as exemplary placement of respective ferrite strips in the channels.

FIG. 9 is a perspective view of waveguide channels 850 and 855 showing the relationship between a single ferrite in each channel. The displacement c of each ferrite strip 840 may be used to influence the phase shift characteristics of RF signals through the respective waveguide channel 850 and 855.

Figure 10:
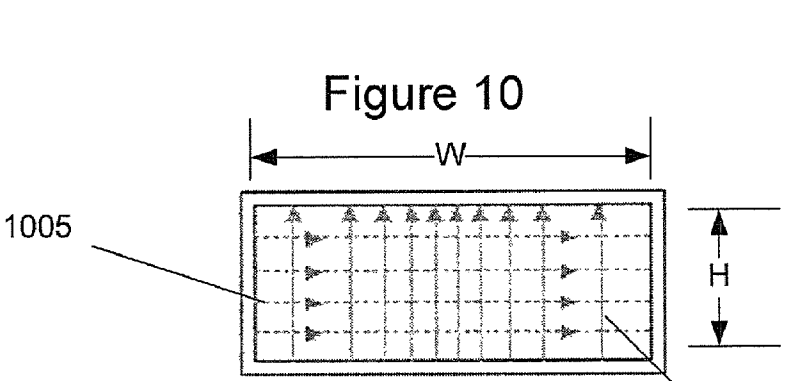
FIGS. 10 through 12 illustrate propagation of an RF signal along a rectangular waveguide in the $TE_{01}$ mode.
Figure 11:
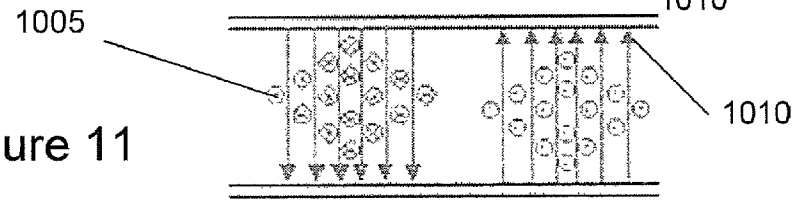
Figure 12:
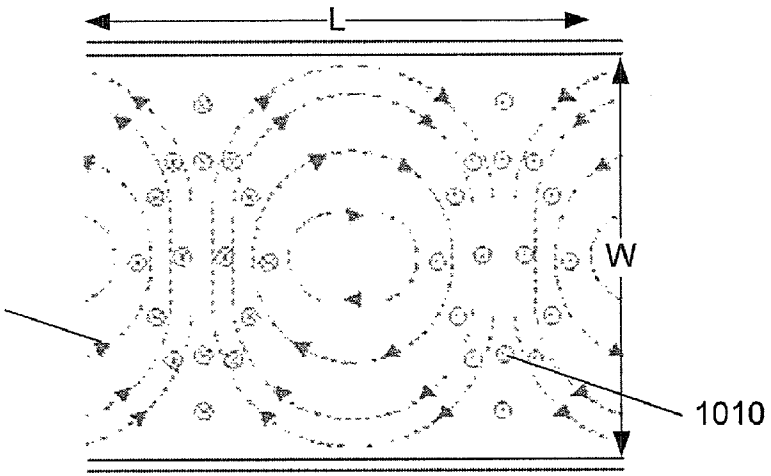

FIG. 10 through FIG. 12 show the propagation characteristics of an RF signal through a rectangular waveguide channel such as those shown at 850 and 855. The RF waves propagate through the rectangular waveguide channel in a transverse electromagnetic mode ($TE_{01}$). In this mode, the RF signals are circularly polarized with the magnetic field lines 1005 substantially perpendicular to the electric field lines 1010. As shown in FIG. 11, the magnetic field lines 1005 and electric field lines 1010 alternate in direction with respect to a given point along the height H of the waveguide channel as the RF wave propagates along the length L of the channel. FIG. 12 is a top view of the magnetic field lines 1005 and electric field lines 1010 of the RF signal as it propagates along length L. The tip of the magnetic field vector at a fixed point in space describes a circle as time progresses. The vector tip generates a helix along the length L.

The circular polarization of RF signals propagating along the length L of the waveguide channel depends on its direction of propagation with respect to a reference port. The propagation of an RF signal in a first direction along length L is viewed as a right-hand circular polarized signal with respect to the reference port of the waveguide channel while the propagation of an RF signal in a second, opposite direction along the length L is viewed as a left-hand circular polarized signal with respect to the reference port.

In the gyrator shown in FIG. 8, a phase shift may be imposed on an RF signal depending on whether the RF signal is a right-hand circular polarized signal or a left-hand circular polarized signal. As noted above, the type of circular polarization may be dependent on the direction of propagation of the RF signal through the waveguide channel as viewed from the reference port.

In operation, the constant magnetic field generated by the magnet 705 or 815 is used to generate a static magnetic field that aligns the magnetic dipoles of the ferromagnetic material of a waveguide channel so that the net magnetic dipole moments are substantially constant. When the RF signal passes through the waveguide channel, the alternating magnetic field generated by the RF signal causes the magnetic dipoles of the ferrite strips to precess at a frequency corresponding to the frequency of the alternating magnetic field. With the ferrite strips displaced from the side walls of the waveguide channel, the precession results in phase shifting properties through the waveguide channel that are dependent on whether the RF signal propagating through the waveguide channel is right-hand polarized or left-hand polarized with respect to the reference port.

Figure 13:
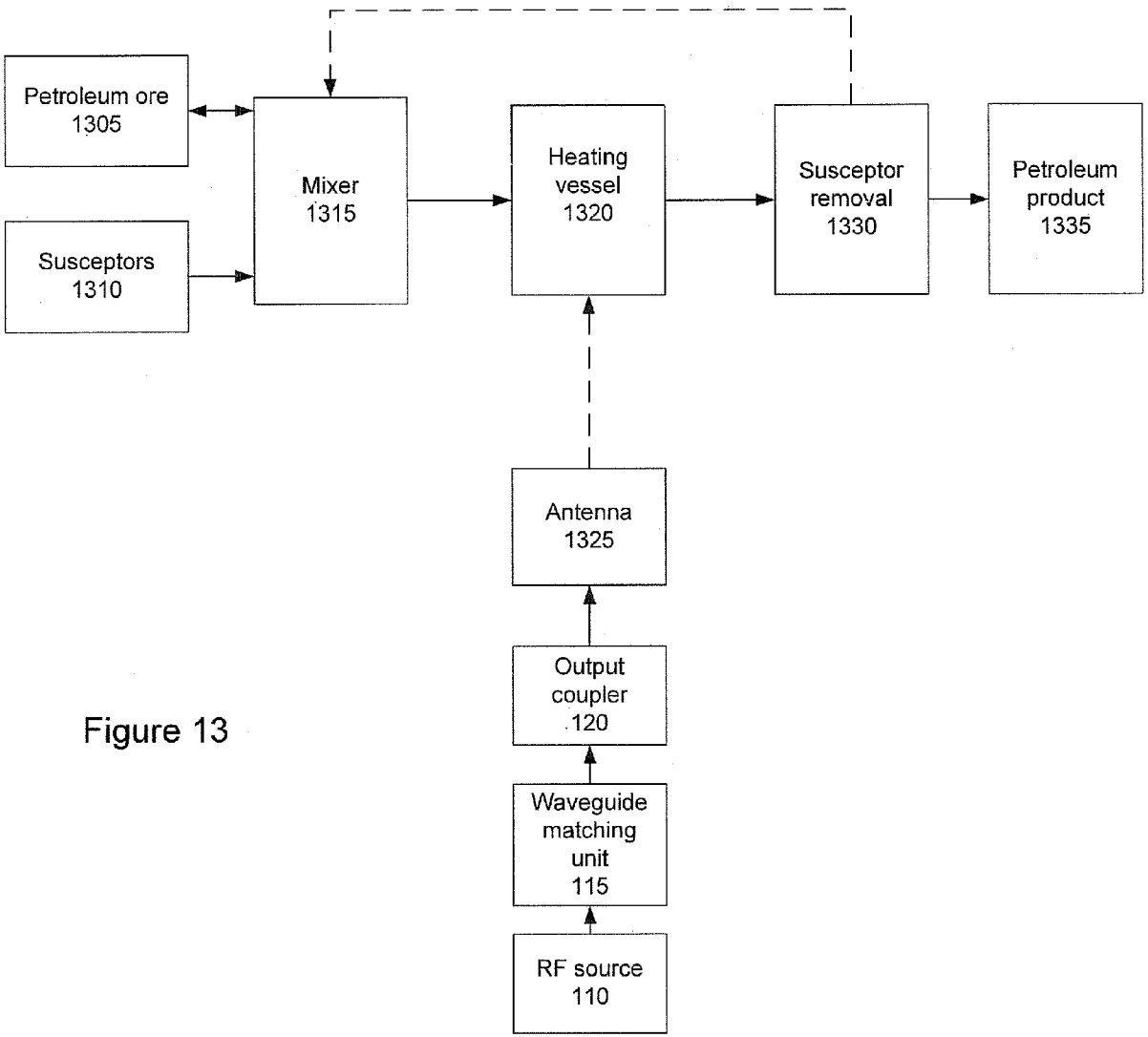
FIG. 13 is a block diagram showing use of the waveguide matching unit in a heating system used to produce a petroleum product.

FIG. 13 shows application of the waveguide matching unit will 115 in the context of processing a petroleum product. A container 1305 is included, which contains a first substance with a dielectric dissipation factor, epsilon, less than 0.05 at 3000 MHz. The first substance, for example, may comprise a petroleum ore, such as bituminous ore, oil sand, tar sand, oil shale, or heavy oil. A container 1310 contains a second substance comprising susceptor particles. The susceptors particles may comprise as powdered metal, powdered metal oxide, powdered graphite, nickel zinc ferrite, butyl rubber, barium titanate powder, aluminum oxide powder, or PVC flour. A mixer 1315 is provided for dispersing the second susceptor particle substance into the first substance. The mixer 1315 may comprise any suitable mixer for mixing viscous substances, soil, or petroleum ore, such as a sand mill, soil mixer, or the like. The mixer may be separate from container 1305 or container 1310, or the mixer may be part of container 1305 or container 1310. A heating vessel 1320 is also provided for containing a mixture of the first substance and the second substance during heating. The heating vessel may also be separate from the mixer 1315, container 1305, and container 1310, or it may be part of any or all of those components.

The heating vessel 1320 is used to heat its contents based on microwave RF energy received from an antenna 1325. The RF power is provided from RF source 110 through the waveguide matching unit 115. The RF power is provided to the output coupler 120 and, therefrom, to the antenna 1325 for provision to the heating vessel 1320. The antenna 1325 may be a separate component positioned above, below, or adjacent to the heating vessel 1320, or it may comprise part of the heating vessel 1320. Optionally, a further component, susceptor particle removal component 1330 may be provided, which is capable of removing substantially all of the second substance comprising susceptor particles from the first substance. Susceptor particle removal component 1330 may comprise, for example, a magnet, centrifuge, or filter capable of removing the susceptor particles. Removed susceptor particles may then be optionally reused in the mixer 1315. A heated petroleum product 7 may be stored or transported at 1335.

The invention claimed is:

1. A gyrator comprising:

a first waveguide having first and second ports connected by a first waveguide channel, wherein an RF signal propagating through the first waveguide channel is phase shifted by about 90° when propagating from the first to the second port, and is phase shifted by about 0° when propagating from the second port to the first port; and a second waveguide third and fourth ports connected by a second waveguide channel, wherein an RF signal propagating through the second waveguide channel is phase shifted by about 0° when propagating from the third to the fourth port, and is phase shifted by about 90° when propagating from the fourth port to the third port.

2. The gyrator of claim 1, wherein each of the first and second waveguides comprises:

a waveguide channel;

a magnet having a static magnetic field;

at least two pole pieces directing the magnetic field of the magnet into the waveguide channel; and one or more ferrite strips proximate at least one of the pole pieces and extending at least partially along a length of the waveguide channel.

3. The waveguide matching unit of claim 1, wherein the gyrator is adapted to differentially phase shift an RF signal therethrough depending on whether the RF signal is propagated along a forward or reflected power path of the gyrator.

4. The waveguide matching unit of claim 1, wherein the gyrator differentially phase shifts RF signals depending on whether the RF signal propagating therethrough is left-hand circularly polarized or right-hand circularly polarized.

5. The waveguide matching unit of claim 1, wherein the hybrid coupler, gyrator, and combiner are passive microwave components.

6. The waveguide matching unit of claim 1, wherein the combiner is a Magic T combiner.

7. The waveguide matching unit of claim 1, wherein the gyrator comprises:

a first waveguide that phase shifts forward propagating RF signals by about 90° and reflected propagating RF signals by about 0°; and a second waveguide that phase shifts reflected propagating RF signals by about 90° and forward propagating RF signals by about 0°.

8. The waveguide matching unit of claim 7, wherein each of the first and second waveguides comprises:

a waveguide channel;

a magnet having a static magnetic field;

at least two pole pieces directing the magnetic field of the magnet into the waveguide channel; and one or more ferrite strips proximate at least one of the pole pieces and extending at least partially along a length of the waveguide channel.

9. A waveguide matching unit comprising:

a hybrid coupler adapted to receive an RF input signal from an RF source to provide first and second orthogonal RF signals corresponding to the RF input signal;

a gyrator receiving the first and second orthogonal signals from the hybrid coupler and adapted to orthogonally phase shift the first and second orthogonal RF signals to provide third and fourth orthogonal RF signals;

a combiner adapted to combine the third and fourth orthogonal RF signals for provision as a forward path RF output signal of the waveguide matching unit, wherein the forward path RF output signal has a power magnitude that substantially corresponds to a power magnitude of the RF input signal received from the RF source; and wherein the gyrator and hybrid coupler are adapted to execute phase shifting operations on reflected RF signals received by the combiner to generate a reflected RF feedback signal having a power magnitude that substantially corresponds to a power magnitude of the reflected RF signal, and wherein the phase shifting operations further minimize reflected RF power returned to the RF source.

10. A radio frequency (RF) system comprising:

an output coupler having first, second, and third ports, wherein the output coupler combines RF signals received at the first and second ports for provision to the third port that provides RF energy to a load;

a waveguide matching unit having first, second, and third ports, wherein the first port of the waveguide matching unit is adapted to receive an RF signal from an RF source and wherein the waveguide phase shifts the RF signal received from the RF source by about 90° for provision at the second port of the waveguide matching unit, wherein the RF signal at the second port of the waveguide matching unit is provided to the first port of the output coupler;

wherein the waveguide matching unit is adapted to receive a reflected RF signal returned from the first port of the output coupler to the second port of the waveguide matching unit, wherein the waveguide matching unit phase shifts the reflected RF signal received at its second port by about 90° for provision at the third port of the waveguide matching unit, the phase shifted signal at the third port of the waveguide matching unit being provided to the second port of the output coupler, the RF signal provided from the second port of the waveguide matching unit to the first port of the output coupler having a power magnitude that substantially corresponds to a power magnitude of the RF signal received at the first port of the waveguide matching unit, and wherein the phase shifted signal at the third port of the waveguide matching unit has a power magnitude that substantially corresponds to a power magnitude of the reflected RF signal.

11. The RF system of claim 10, wherein the waveguide matching unit comprises a gyrator that differentially phase shifts a RF signal propagating therethrough depending on whether the RF signal is propagated along a forward or reflected power path through the gyrator.

12. The RF system of claim 10, wherein the gyrator differentially phase shifts RF signals depending on whether the RF signal propagating therethrough is left-hand circularly polarized or right-hand circularly polarized.

13. The RF system of claim 10, wherein the output coupler is a three port device having the following scatter matrix characteristics:

$$S_{ij} = \frac{1}{\sqrt{2}}\begin{pmatrix} 0 & 1 & 0 \\ 1 & 0 & 1 \\ 0 & 0 & 0 \end{pmatrix}.$$

14. The RF system of claim 10, wherein the output coupler is a three port device having the following scatter matrix characteristics:

$$S_{ij} = \frac{1}{\sqrt{2}}\begin{pmatrix} 0 & 1 & 0 \\ 1 & 0 & j \\ 0 & 0 & 0 \end{pmatrix}.$$

15. The RF system of claim 10, wherein the gyrator comprises:

a first waveguide that phase shifts forward propagating RF signals by about 90° and reflected propagating RF signals by about 0°; and a second waveguide that phase shifts reflected propagating RF signals by about 90° and forward propagating RF signals by about 0°.

16. The RF system of claim 15, wherein each of the first and second waveguides comprises:

a waveguide channel;

a magnet having a static magnetic field;

at least two pole pieces directing the magnetic field of the magnet into the waveguide channel; and one or more ferrite strips proximate at least one of the pole pieces and extending at least partially along a length of the waveguide channel.

17. The RF system of claim 10, wherein the waveguide matching unit comprises:

a hybrid coupler receiving the RF input signal from the RF source to provide first and second orthogonal RF signals corresponding to the RF input signal;

a gyrator receiving the first and second orthogonal signals from the hybrid coupler, wherein the gyrator is adapted to orthogonally phase shift the first and second orthogonal RF signals to provide third and fourth orthogonal RF signals;

a combiner adapted to combine the third and fourth orthogonal RF signals for provision as a forward path RF output signal of the waveguide matching unit, wherein the forward path RF output signal has a power magnitude that substantially corresponds to a power magnitude of the RF input signal from the RF source; and wherein the gyrator and hybrid coupler execute phase shifting operations on reflected RF signals received at the combiner from the output coupler to generate a reflected RF feedback signal having a power magnitude that substantially corresponds to a power magnitude of the reflected RF signal, the reflected RF feedback signal being provided to the second port of the output coupler, the phase shifting operations further minimizing reflected RF power returned from the first port of the waveguide matching unit to the RF source.

18. The RF system of claim 17, wherein the combiner is a Magic T combiner.

19. A radio frequency (RF) system comprising:

a forward RF signal path adapted to provide RF energy to a load, the forward energy path including a hybrid coupler having first, second, third, and fourth ports, wherein the hybrid coupler is adapted to receive an RF signal at the first port to provide first and second orthogonal RF signals at the second and third ports of the hybrid coupler;

a gyrator having a first port receiving the first orthogonal RF signal from the second port of the hybrid coupler and a second port receiving the second orthogonal RF signal from the third port of the hybrid coupler, wherein the gyrator phase shifts the first orthogonal RF signal by about 90° for provision to a third port of the gyrator while phase shifting the second orthogonal RF signal received at its second port by about 0° for provision to a fourth port of the gyrator;

a combiner receiving the RF signals from the third and fourth ports of the gyrator and combining the RF signals at the third and fourth ports of the gyrator for provision to an output port of the first combiner;

a reflected RF signal path adapted to redirect reflected RF signals back through the forward RF signal path, wherein the reflected RF signals are reflected back to the output port of the first combiner and provided to the third and fourth ports of the gyrator, the gyrator phase shifting the RF signal received at its third port by about 0° for provision to the second port of the hybrid coupler, and phase shifting the RF signal received at its fourth port by about 90° for provision to the third port of the hybrid coupler, wherein the hybrid coupler generally maintains the phase of the RF signal received at its second port at about 0° and phase shifts the RF signal received at its third port by about 90° for provision at the fourth port of the hybrid coupler;

an output coupler combining RF signals from the combiner and RF signals from the fourth port of the hybrid coupler.

20. The RF system of claim 19, wherein the gyrator differentially phase shifts RF signals depending on whether the RF signal propagating therethrough is left-hand circularly polarized or right-hand circularly polarized.

21. The RF system of claim 19, wherein the hybrid coupler, gyrator, and combiner are passive microwave components.

22. The RF system of claim 19, wherein the output coupler is a three port device having the following scatter matrix characteristics:

$$S_{ij} = \frac{1}{\sqrt{2}}\begin{pmatrix} 0 & 1 & 0 \\ 1 & 0 & 1 \\ 0 & 0 & 0 \end{pmatrix}.$$

23. The RF system of claim 19, wherein the output coupler is a three port device having the following scatter matrix characteristics:

$$S_{ij} = \frac{1}{\sqrt{2}}\begin{pmatrix} 0 & 1 & 0 \\ 1 & 0 & j \\ 0 & 0 & 0 \end{pmatrix}.$$

24. The RF system of claim 19, wherein the combiner is a Magic T combiner.

* * * * *